US008590408B2

(12) United States Patent
Stein et al.

(10) Patent No.: US 8,590,408 B2
(45) Date of Patent: Nov. 26, 2013

(54) VIBRATION EXCITER FOR A GROUND COMPACTOR AND GROUND COMPACTOR

(75) Inventors: Gilbert Stein, Neuwied (DE); Alexander Dykhnich, Neuwied (DE)

(73) Assignee: BOMAG GmbH, Boppard (DE)

( * ) Notice: Subject to any disclaimer, the term of this patent is extended or adjusted under 35 U.S.C. 154(b) by 284 days.

(21) Appl. No.: 13/116,184

(22) Filed: May 26, 2011

(65) Prior Publication Data

US 2011/0290048 A1 Dec. 1, 2011

(30) Foreign Application Priority Data

May 28, 2010 (DE) ..... 10 2010 021 961

(51) Int. Cl.
*F16H 33/10* (2006.01)

(52) U.S. Cl.
USPC ..... 74/87; 74/86

(58) Field of Classification Search
USPC ..... 74/86, 87
See application file for complete search history.

(56) References Cited

U.S. PATENT DOCUMENTS

| | | | | |
|---|---|---|---|---|
| 1,241,414 | A * | 9/1917 | Berend | 74/473.22 |
| 4,576,059 | A * | 3/1986 | Nishu et al. | 74/473.34 |
| 4,693,135 | A * | 9/1987 | LaRocca et al. | 74/473.21 |
| 4,916,966 | A * | 4/1990 | Weishaupt et al. | 74/473.29 |
| 4,960,009 | A * | 10/1990 | Schultz et al. | 74/473.29 |
| 5,144,852 | A * | 9/1992 | Yokoyama | 74/473.36 |
| 5,247,848 | A * | 9/1993 | Sabel | 74/473.36 |
| 5,499,919 | A * | 3/1996 | Thomas | 434/45 |
| 5,560,252 | A * | 10/1996 | Nishigai et al. | 74/473.36 |
| 7,059,802 | B1 | 6/2006 | Geier et al. | |
| 7,178,795 | B2 * | 2/2007 | Huprikar et al. | 267/141.1 |
| 7,464,621 | B2 * | 12/2008 | Mathis et al. | 74/473.3 |
| 2004/0005191 | A1 | 1/2004 | Geier et al. | |

FOREIGN PATENT DOCUMENTS

| | | |
|---|---|---|
| CH | 537 217 A | 5/1973 |
| DE | 23 37 213 A1 | 2/1975 |
| DE | 601 32 535 T2 | 1/2009 |
| EP | 0 239 561 A2 | 9/1987 |

* cited by examiner

*Primary Examiner* — David M Fenstermacher

(74) *Attorney, Agent, or Firm* — Wood, Herron & Evans, LLP

(57) ABSTRACT

A vibration exciter for a ground compactor comprises an exciter shaft having at least one exciter weight disposed thereon and having at least one turnover weight which is disposed so that it can rotate relative to this exciter shaft. A ground compactor having such a vibration exciter is also disclosed.

12 Claims, 5 Drawing Sheets

VIBRATION EXCITER FOR A GROUND COMPACTOR AND GROUND COMPACTOR

The present application claims priority under 35 U.S.C. §119 of German Patent Application No. 10 2010 021 961.4, filed May 28, 2010, the disclosure of which is hereby incorporated herein by reference in its entirety.

FIELD OF THE INVENTION

The present invention relates to a vibration exciter (or an apparatus for exciting vibrations) for a ground compactor. The present invention further relates to a ground compactor having at least one such vibration exciter.

BACKGROUND OF THE INVENTION

A generic vibration exciter, as well as a ground compactor equipped therewith, are known, for example, from U.S. Pat. No. 7,059,802 B1. In order to improve the compacting action of the ground compactor shown, the compacting rollers are exposed to vibrations in compacting operation. The vibrations are generated by one (or by a plurality of) vibration exciters. A vibration exciter comprises an exciter shaft driven rotationally about an axis of rotation, on which a so-called exciter weight (exciter mass) is disposed eccentrically. In the following, "exciter weight" designates the structural entirety of exciter weight and exciter shaft unless otherwise specified. Vibrations which can be used for compaction are generated as a result of the imbalance produced by the eccentricity.

Furthermore, at least one so-called turnover weight which is also configured eccentrically (i.e., the center of mass lies outside the axis of rotation) is disposed on the exciter shaft. The turnover weight is rotationally decoupled with respect to the exciter shaft and the exciter weight located thereon or it can rotate about an axis of rotation and can adopt different angular positions with respect to the exciter weight in a rotational range delimited, for example, by stops. The axis of rotation of the exciter shaft with the exciter weight and the axis of rotation of the turnover weight relative to the exciter weight lie coaxially to one another.

The turnover weights are repeatedly entrained by the rotating exciter shaft by means of a pin (or the like) from a lower position as far as a kinematically determined turnover or rollover point at which the turnover weights roll over or turn over due to gravity and impact from the opposite side on a stop provided for this purpose on the exciter shaft or the exciter weight. The turnover weight can therefore, depending on the direction of rotation of the exciter shaft, adopt a position in which the mass of the turnover weight is added in the rotational movement to the exciter weight whereby the vibration amplitude is increased and another position in which the mass of the turnover weight acts against the mass of the exciter weight, whereby the vibration amplitude is reduced. The arrangement of exciter weight and turnover weight in the vibration exciter therefore allows the vibration intensity of the vibration exciter to be better regulated.

A disadvantage in the vibration exciters known from the prior art in particular is the uncontrolled recoil of the turnover weights upon impact. Another and frequently associated disadvantage is that frequently no distinct turnover of the turnover weight takes place. In practical operation it has further been shown that the turnover weight can adopt a neutral position in the known arrangements. As a result, for example, the position in which the turnover weight adds to the exciter weight cannot be reliably ensured or the maximum amplitude of the exciter unit cannot be achieved. As a result, the maximum compaction performance of the compactor cannot be provided.

It is the object of the present invention to further develop a vibration exciter of the relevant type in such a manner that the disadvantages associated with the prior art are obviated or at least significantly reduced.

SUMMARY OF THE INVENTION

In contrast to the vibration exciter known from U.S. Pat. No. 7,059,802 B1 in which the axes of rotation coincide or lie coaxially to one another and are therefore identical, it is provided according to one embodiment of the present invention that the axes of rotation of the exciter shaft or of the at least one exciter weight fastened thereon and the at least one turnover weight are axially offset with respect to one another. Axially offset means in the sense of the present invention that the two axes of rotation (axis of rotation of the exciter shaft with exciter weight and axis of rotation of the turnover weight) do not lie coaxially to one another and differ from one another in their spatial position. The two axes of rotation therefore do not lie on one another but adjacent to one another. According to one aspect of the present invention, the turnover weight does not pivot relative to the exciter weight concentrically to the axis of rotation of the exciter shaft. The turnover weight, on the contrary, can pivot on an eccentric rotational path with respect to the axis of rotation of the exciter shaft compared with the exciter weight.

As a result of this axial offset of the axes of rotation, it is possible to decisively vary the kinematic conditions so that from a certain angle of rotation, the at least one turnover weight is always pressed onto the stop on the exciter shaft or the exciter weight. By this means a distinct turning and an associated change of amplitude is ensured even if the turnover weight should recoil after the impact. The turnover weight therefore no longer adopts a neutral position. The recoil therefore has a less disadvantageous effect. Furthermore, the arrangement according to one embodiment of the present invention also facilitates the switching of the direction of rotation of the vibration arrangement.

In principle, according to one aspect of the present invention, the two axes of rotation can lie with respect to one another such that they intersect at one point or are skew with respect to one another. It is preferable however that the axes of rotation of the exciter shaft and the at least one turnover weight are oriented parallel to one another. Optimal results can be obtained with this arrangement of the two axes of rotation with respect to one another. Furthermore, this embodiment is characterised by being comparatively easy to assemble.

The axial offset of the two axes of rotation with respect to one another is further ideally selected in such a manner that its position stabilizing effect on the positioning of the turnover weight with respect to the exciter weight has almost the same effect on the two outer adjustment positions. According to a further development it is therefore provided that the axis of rotation of the at least one turnover weight is offset relative to the axis of rotation of the exciter shaft or the exciter weight by a defined value, where this value is measured as the inward-pointing distance on the angle bisector of the turning angle. The specific geometrical relationships of this embodiment will be explained in further detail hereinafter in connection with the figures.

The axial offset can fundamentally be varied in a wide range. The positive effect of the present invention appears however even with a relatively small axial offset. A comparatively small axial offset additionally has the advantage that the vibration exciter according to the present invention can be kept compact in its manner of construction as previously. Exceptional results are accordingly achieved if the distance of the axes of rotation on the angle bisector lies in the range of a few millimeters and preferably in the range of 1 mm to 15 millimeters and especially in the range of 1.5 to 10 millimeters, quite particularly in the range of 2 to 5 millimeters. The distance is measured in this case in the plane which is intersected perpendicularly by at least the axis of rotation of the exciter shaft. In particular, in this embodiment it is ideal if the two axes of rotation lie parallel to one another and consequently both intersect this plane perpendicularly. If the two axes of rotation do not run parallel to one another, the offset is determined from the shortest distance of the two axes of rotation to one another.

According to a further development it is provided in one embodiment that the vibration exciter has only one exciter weight. This exciter weight is preferably formed in one piece with the exciter shaft. By this means in particular the assembly and maintenance of the entirety of exciter shaft and exciter weight or the vibration exciter is appreciably simplified. It is however naturally also possible to form a plurality of exciter weights in one piece with the exciter shaft or for example, in addition to an exciter weight formed in one piece with the exciter shaft, to provide at least one other exciter weight which is connected to the exciter shaft and which is rotationally fixed, for example by means of a screw connection.

The number of the turnover weights per exciter shaft can also vary. According to one embodiment of the present invention, it is preferable if the vibration exciter has only one turnover weight. It is further particularly preferred in one embodiment that the vibration exciter has only one turnover weight and only one exciter weight.

Specifically the axial offset of the two axes of rotation can be achieved in different ways.

One possibility consists, for example, in providing a bearing ring on the exciter shaft which has an inner shell disposed eccentrically with respect to the axis of rotation of the exciter shaft on which the turnover weight is finally guided. To this end, for example, a corresponding bearing journal on the turnover weight is guided in or through the bearing ring on the exciter shaft. This bearing ring can be connected in a rotationally fixed manner to the exciter shaft or however, preferably formed in one piece with the exciter shaft. If the bearing ring comprises an independent component, the variant according to the present invention can, for example, be retrofitted comparatively easily in a conventional exciter with coaxial axes of rotation. Overall a hub connection or a hub bearing is thus achieved in this way.

Alternatively or additionally, a hub connection, comprising a bearing hub or bearing journal and a bearing eye, can also be provided for mounting the turnover weight on the exciter weight. In this embodiment, the bearing journal on the turnover weight is received in an eye in the exciter weight. The eye is configured in the form of a hole. This embodiment is also particularly easy to assemble since the turnover weight can be pushed directly onto the exciter weight and then stabilized by the exciter weight itself in its position along the axis of rotation or in the axial direction at least in one direction. In this embodiment in other words, the turnover weight is connected rotationally to the exciter weight or to the exciter shaft in the region of its one axial end by means of a sliding bolt (i.e., bearing journal). This sliding bolt is received directly (i.e., without a rolling body) in a corresponding sliding hole (i.e., hole) in the exciter weight and/or the exciter shaft. This will be explained in detail hereinafter in connection with the figures.

In principle, the preceding bearing arrangement can also be used conversely. In a further embodiment, consequently for example, at least at one axial end the turnover weight has a bearing ring preferably configured in one piece with the turnover weight, in which a corresponding bearing journal is guided in or through on the structural unit comprising exciter weight and exciter shaft.

In practical use it has been found that a combination of different mounting variants of the turnover weight on the structural unit comprising exciter weight and exciter shaft is ideal in regard to assembly, maintenance and operation. An aspect of this embodiment therefore consists in that the turnover weight is not only mounted by means of a bearing on the structural unit comprising exciter weight and exciter shaft but by means of a plurality of bearings, in particular two. In principle, the two bearings can be constructed in the same manner for this purpose so that for example, two pins located coaxially to one another and behind one another in the axial direction are provided on the turnover weight, each engaging in a corresponding recess on the structural unit comprising exciter weight and exciter shaft.

Alternatively however, differently constructed bearings can be combined with one another in a vibration exciter according to the present invention. It is particularly favorable in this case if the turnover weight in the axial direction of the parallel located axes of rotation coming from the motor initially embraces a bearing ring on the exciter shaft with eccentric outer shell with respect to the axis of rotation of the exciter shaft and thereafter in the axial direction engages with a pin whose axis is coaxial to the longitudinal axis of the bearing ring, in a hole on the structural unit comprising exciter weight and exciter shaft. This special arrangement particularly simply prevents an axial displacement of the turnover weight with respect to the structural unit comprising exciter weight and exciter shaft and can at the same time be rapidly and simply mounted by pushing the turnover weight onto this structural unit.

In order to fundamentally ensure the axial positioning of the turnover weight on the exciter shaft, in the axial direction of the axis of rotation of the exciter shaft, the bearing ring of the turnover weight is located directly between a drive-side bearing and a stop on the exciter weight or on the exciter shaft. In the axial direction the turnover weight is therefore fixed in its position between the stop and the drive-side bearing. This embodiment is advantageous insofar as additional fixing means are not required for axial securing of the turnover weight.

It is further preferred not to configure the exciter shaft as continuous but as multi-membered. Those parts of the structural unit comprising exciter weight and exciter shaft which lie directly on the axis of rotation of this unit are counted as the exciter shaft. In a multi-membered configuration of the exciter shaft, this is therefore interrupted at least once between its two outer ends lying in the axial direction so that a space is obtained between the individual members. The individual members of the exciter shaft are thereby interconnected via the exciter weight, which is optionally also configured as multi-membered. This space serves in particular to simplify assembly since a pushing of the turnover weight onto the structural unit comprising exciter weight and exciter shaft is thereby simplified. In addition, this arrangement enables a particularly favorable weight distribution.

According to a further development it is provided that the turning angle for the turnover weight lies in the range of 120° to 200° and preferably at about 130°. The turning angle is determined in the plane perpendicular to the axis of rotation of the turnover weight with respect to the exciter shaft or with respect to the exciter weight and is determined by the two maximum pivot positions of the turnover weight with respect to the exciter weight or the exciter shaft.

A motor, for example, is provided for driving the exciter shaft, which is connected directly (e.g., via a flange connection or splined shaft connection) or indirectly (i.e., via at least one driving intermediate piece) to the exciter shaft. Such a motor is in particular a hydraulic motor. It is further preferably provided that the axis of rotation of the motor is in alignment with or lies coaxially with the axis of rotation of the exciter shaft in order to enable as direct as possible and therefore structurally simple transmission of the drive power of the motor to the exciter shaft.

The solution of the object also extends to a ground compactor comprising at least one vibration exciter according to the present invention. Such a ground compactor is, for example, a plate vibrator, a hand-guided roller or a roller with an operator's platform, wherein at least one compacting band of a ground compactor is acted upon by vibrations by means of at least one vibration exciter according to the present invention. Such a roller can, for example, comprise a so-called trench roller.

BRIEF DESCRIPTION OF THE DRAWINGS

The present invention is explained in detail hereinafter as an example and in a non-restrictive manner by reference to the figures. In the figures.

DETAILED DESCRIPTION OF THE INVENTION

Figure 1:
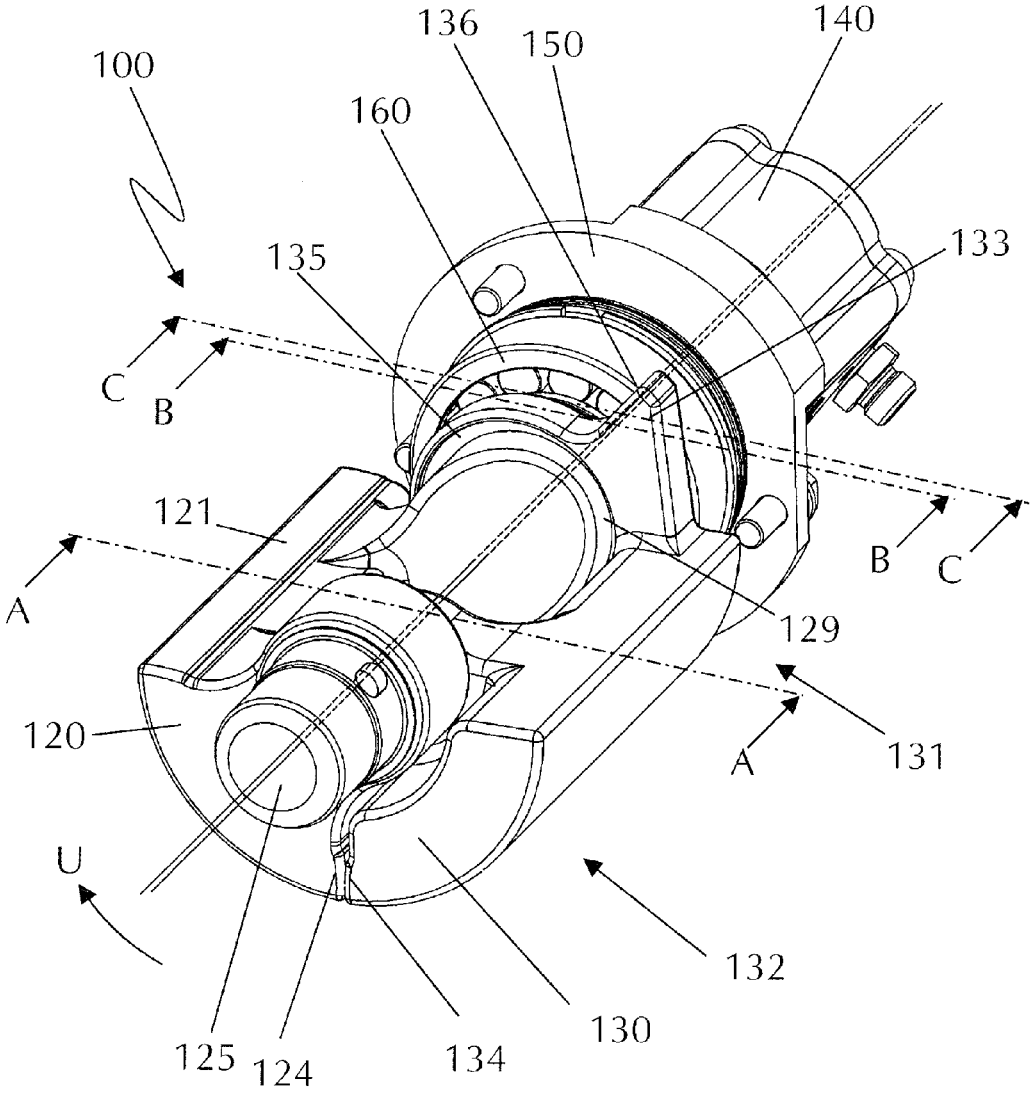
FIG. 1 shows a vibration exciter according to one embodiment of the present invention in a perspective view.

FIG. 1 shows a vibration exciter 100 according to one embodiment of the present invention in a perspective view. The vibration exciter 100 comprises an exciter weight 120 which is formed in one piece with a partially visible exciter shaft 110 and a turnover weight 130. The exciter weight 120 and the exciter shaft 110 together form a structural unit. The vibration exciter 100 further comprises a motor 140, wherein in the present exemplary embodiment this specifically comprises a hydraulic motor. The motor 140 is coupled onto the exciter shaft 110 in alignment. The common axis of rotation is designated by $D_g$. The exciter weight 120 or the exciter mass 120 are disposed eccentrically with respect to this axis of rotation $D_g$ so that during rotation about the axis of rotation $D_g$ in the desired manner, useful vibrations are produced. On the side opposite the motor 140, the exciter shaft 110 with a bearing journal 125 projecting in the axial direction (along $D_g$) is received in a bearing not shown in further detail here. The entire vibration exciter 100 can be fastened by means of the flange 150 on a housing or the like not shown here. In the region of the flange 150 the exciter shaft 110 driven by the motor 140 is supported by a roller bearing 160, whereby a rotational decoupling with respect to the fixed housing (not visible) is accomplished.

Figure 3A:
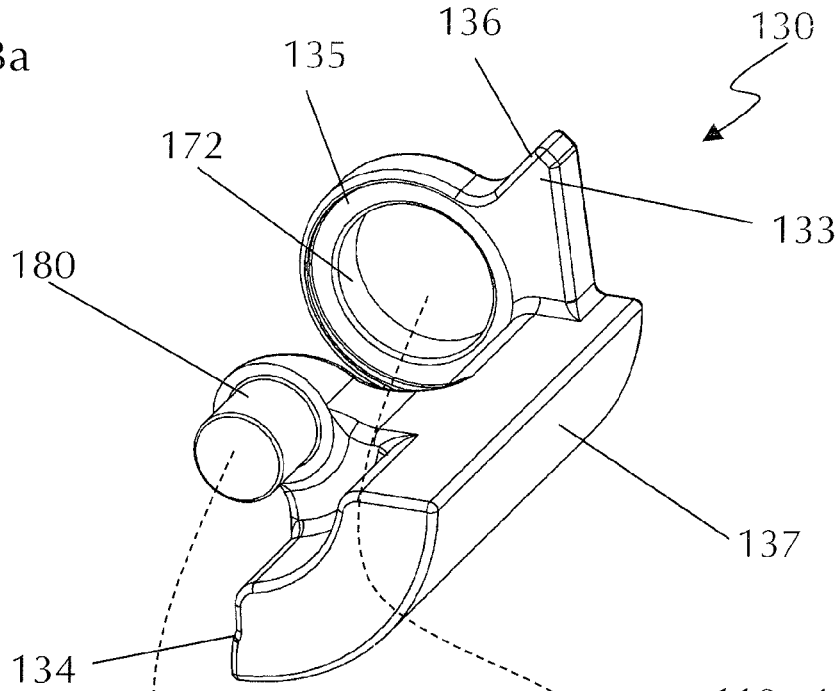
FIG. 3*a* shows the turnover weight of the vibration exciter from FIG. 1.
Figure 3B:
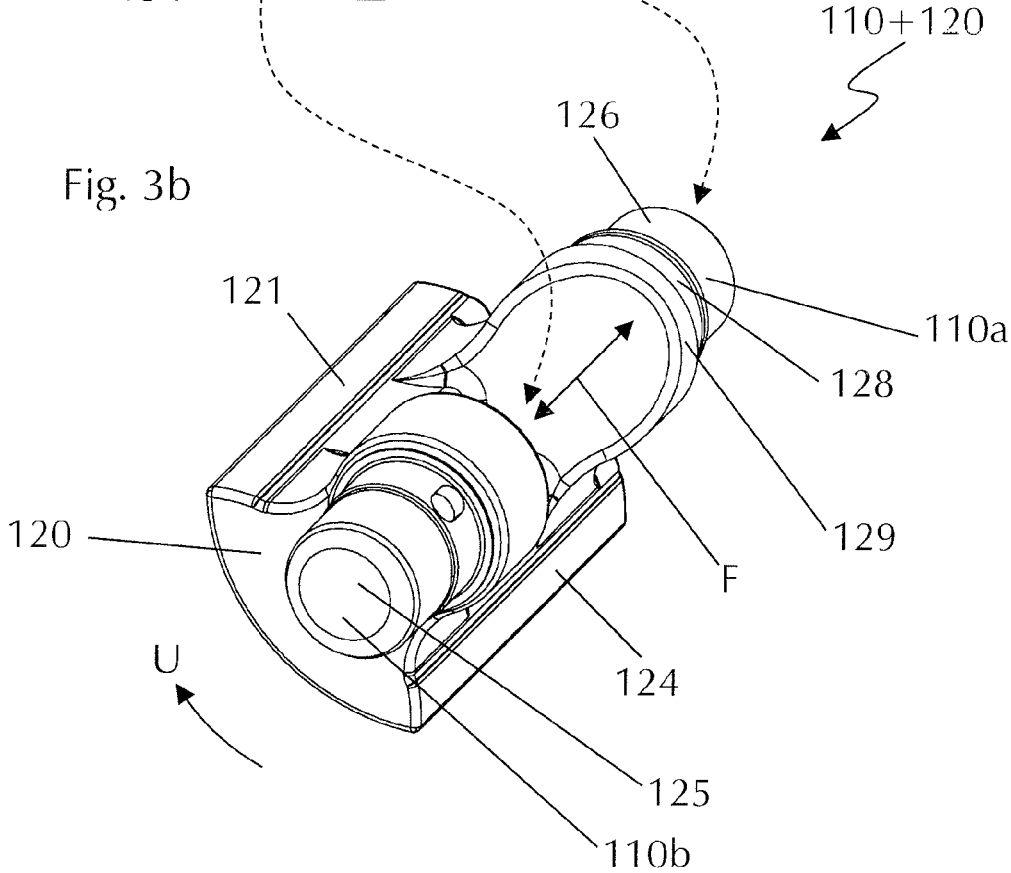
FIG. 3*b* shows the structural unit comprising exciter weight and exciter shaft from FIG. 1.

The turnover weight 130 is disposed on the one-piece unit comprising exciter shaft 110 and exciter weight 120 so that it can rotate relative to the exciter weight by means of two bearings 131 and 132 located one behind the other in the axial direction of the axes of rotation $D_g$ and $D_u$. The bearings 131 and 132 can be designated in relation to the motor 140 in the axial direction as front bearing point 131 and rear bearing point 132. Further details of the two bearings 131 and 132 can be seen in FIGS. 3*a* and 3*b*. FIG. 3*a* specifically shows the turnover weight 130 and FIG. 3*b* shows the structural unit comprising exciter weight 120 and exciter shaft 110. The dashed arrows in FIGS. 3*a* and 3*b* indicate how the turnover weight 130 is pushed onto the structural unit comprising exciter weight 120 and exciter shaft 110 during preassembly.

The turnover weight 130 comprises a turnover mass 137 having an annular segment-shaped cross-section, having a surface stop 134, a cam 133 having a surface stop 136 opposite to the surface stop 134 in the direction of rotation $D_u$ and a bearing ring 135 in the region of the front bearing 131, wherein the bearing ring 135 has a hollow-cylindrical inner shell 172 configured coaxially to the axis of rotation $D_u$. A cylindrical bearing journal 180 is further provided in the region of the rear bearing 132, wherein the cylinder axis of the bearing journal 180 also lies coaxially to the axis of rotation $D_u$.

The structural unit comprising exciter weight 120 and exciter shaft 110 according to FIG. 3*b* comprises the exciter mass 120 also configured in an annular segment shape. A cylindrical bearing surface 128 is further provided in the region of the front bearing 131, whose cylinder axis runs adjacent to the axis of rotation $D_g$ and coaxially to the axis of rotation $D_u$. In the axial direction the motor 140 is followed by a front driving pin 126 which is ultimately connected to the motor 140 and is mounted in the roller bearing 160 in the built-in state. The axis of this cylindrical bearing journal runs in contrast to the bearing surface 128 coaxially to the axis of rotation $D_g$. In the opposite direction in the axial direction the bearing surface 128 is followed by an annular stop 129 on the exciter shaft 110, which protrudes in the radial direction beyond the bearing surface 128. In the region of the rear bearing 132 along the exciter shaft 110, there is firstly provided a receiving eye (not visible in FIG. 3*b*) in the form of a hole. This is then followed by the bearing journal 125 configured coaxially to the axis of rotation $D_g$. Further provided is a stop surface 121 and a stop surface 124 opposite this stop surface 121 in the direction of excitation of the exciter shaft 110.

FIG. 3*b* further illustrates that the exciter shaft 110 is not configured to be continuous along the axis of rotation $D_g$ but comprises a front member 110*a* and a rear member 110*b* which are separated from one another by a space F in the axial direction. This space F makes it considerably easier to assemble the turnover weight 130 with the structural unit comprising exciter weight 120 and exciter shaft 110, as will be explained in further detail hereinafter. The space F also has the result that in the axial intermediate space between the front bearing point 131 and the rear bearing point 132, substantially no mass is disposed, with the result that an advantageous weight distribution in regard to the generation of vibrations is obtained.

When the turnover weight 130 is inserted along the dashed arrows in FIGS. 3*a* and 3*b* into the unit comprising exciter shaft 110 and exciter weight 120, the front bearing 131 and the rear bearing 132 are thereby obtained overall. Through the space F the bearing journal 180 can be brought to the approximate height of the exciter shaft 110 in relation to the axial direction in front of the hole and then inserted into the hole without the exciter shaft 110 obtruding. In the assembled state the front bearing 131 comprises the bearing journal configured in one piece with the exciter shaft 110 with the cylindrical outer shell 128. The longitudinal axis $D_u$ of this outer shell 128 is axially offset with respect to the axis of rotation $D_g$ of the exciter shaft 110. On the turnover weight 130, mounting is achieved with the bearing ring 135 on the outer shell 128 so that the outer shell 128 is in contact with the inner shell 172. In this region the exciter shaft 110 is therefore guided through the turnover weight 130. The turnover weight 130 is secured towards the motor against any axial displacement directly by the adjacent roller bearing 160. The annular stop 126 is provided away from the motor in the axial direction on the exciter shaft 120, which protrudes in the axial direction radially with respect to the recess in the turnover weight 130 so that during a displacement in the axial direction away from the motor the turnover weight impacts directly against the stop 126 of the exciter shaft 110. Consequently, separate securing means against any axial displacement of the turnover weight 130 with respect to the unit comprising exciter shaft 110 and exciter weight 120 are not required.

The rear bearing 132 has a different structure. There the bearing journal 180 of the turnover weight 130 is mounted in the hole (not visible in FIG. 3*b*) and consequently projects in this region into the structural unit comprising exciter shaft 110 and exciter weight 120.

The structure of the turnover weight 130 will be explained in detail hereinafter with reference to the figures.

Figure 2:
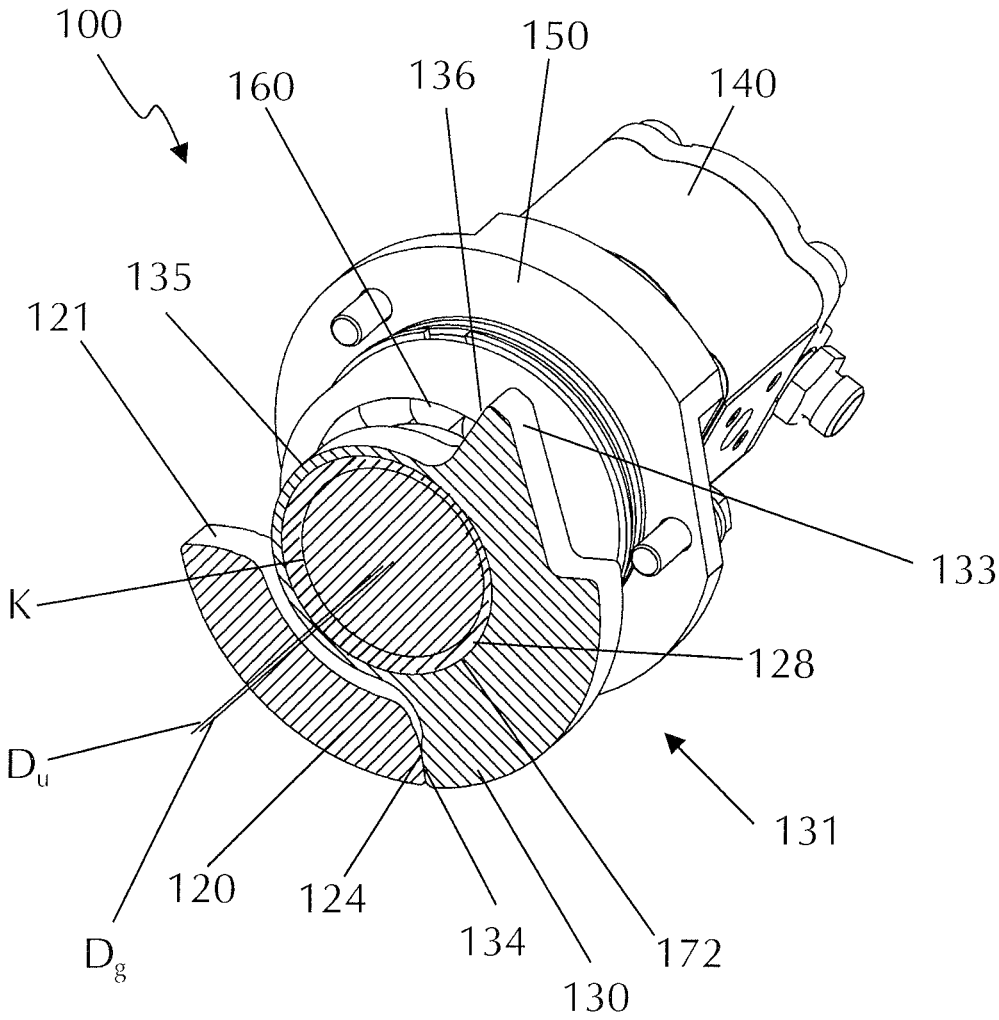
FIG. 2 shows a section through the vibration exciter from FIG. 1 in a perspective view.

In operation the exciter weight 120 is driven rotationally by the motor 140 via the exciter shaft 110. FIGS. 1 and 2 reflect the start-up situation of the vibration exciter 100 in the direction of rotation U of the axis of rotation $D_g$ given in FIGS. 1 and 2, i.e., in an operating state in which the imbalance of the turnover weight 130 acts against the imbalance of the exciter weight 120 (i.e., small amplitude). Starting from the situation shown, for example, in FIGS. 1 and 2, the motor 140 drives the rotation of the exciter shaft 110 about the axis of rotation $D_g$ in the direction of rotation U in the "small amplitude" mode. In this case, the exciter weight is pivoted from the position shown in the figures in the direction of rotation U, whereby the turnover weight 130 co-pivots or pivots subsequently due to gravity as a far as a lower dead point (T) initially in the direction of rotation U. When the turnover weight reaches its lower dead point (T), it no longer co-pivots with the exciter weight 120 until the surface stop 121 of the exciter weight 120 impacts at a specific angle of rotation (angle of revolution of the exciter shaft) against the stop surface 136 on the cam 133 of the turnover weight 130, whereupon the turnover weight 130 is entrained or co-pivoted from its lower dead point against the gravitational force in the direction of revolution U. This process is continued until an upper inflection point O is reached at which the turnover weight 130 rolls over or tips over due to gravity, thereby advances in front of the exciter weight and possibly can even impact from the opposite side with its stop 134 against the flank 124 of the exciter weight 130. This sequence is usually repeated continuously until the physical forces reach a labile equilibrium that is determined from the inertial masses, the frictional forces and the impact parameters. During operation contrary to the direction of rotation U (i.e., "large amplitude" mode), in principle the same phenomena take place correspondingly on the respectively opposite sides in the direction of rotation, wherein in this case imbalance of the turnover weight 130 is added to the imbalance of the exciter weight 120.

If a switchover now takes place from the "small amplitude" operating mode (in the direction of revolution U) into the "large amplitude" operating mode (contrary to the direction of revolution U), the exciter weight initially impacts with its stop 124 against the stop 134 of the turnover weight and thereby pushes the turnover weight contrary to the direction of revolution U away from the exciter weight 120.

The effect of the present invention now lies in the fact that the relative position of the turnover weight 130 with respect to the exciter weight 120 is stabilized by the axial offset of the axes of rotation $D_g$ and $D_u$ according to the present invention and counteracts a neutral positioning the turnover weight. The turnover weight 130 therefore has a different or offset axis of rotation $D_u$ compared with the exciter shaft $D_g$. The offset is thereby accomplished in a plane perpendicular to the two axes of rotation $D_g$ and $D_u$ relative to the line of the neutral position (i.e., angle bisector) in the direction pointing away from the side of the mass body on the turnover weight 130. This special offset consequently enables a distinct tipping over of the turnover weight 130 and counteracts the pushing away of the turnover weight 130 by the exciter weight 120. To this end the turnover weight 130 has the axis of rotation $D_u$ different from the exciter shaft 110 or from the exciter weight 120, which is axially offset relative to the axis of rotation $D_g$ or runs adjacent to this. The two axes of rotation $D_g$ and $D_u$ therefore do not run coaxially to one another. The two axes of rotation $D_g$ and $D_u$ are further parallel to one another.

The sectional view in FIG. 2 illustrates the position of the two axes of rotation $D_g$ and $D_u$ with respect to one another, where the section runs in the region of the front bearing point 131 (the plane of intersection is perpendicular to the axes of rotation $D_g$ and $D_u$). At this bearing point 131 in the region of its front (first) axial end on the eccentric axis of rotation $D_u$ with respect to the axis of rotation $D_g$ of the exciter shaft 110, the turnover weight 130 is mounted so that it can rotate by means of its bearing ring 135 having its inner sliding surface 172 on the exciter shaft 110. The circle K indicates the position of the driving pin 126 relative to the cylindrical bearing surface 128, which is not actually visible in this diagram. It can be clearly see that the axis of rotation $D_g$ of the exciter shaft 110 or the driving pin 126 and the axis of rotation $D_u$ of the turnover weight 130 are not in alignment but are axially offset.

The adjacently located or axially offset arrangement of the axes of rotation $D_g$ and $D_u$ ultimately results during operation that the axis of rotation $D_u$ of the turnover weight 130 moves on an orbit about the fixed axis of rotation $D_g$ of the exciter shaft 110. As a result of the defined spacing of the two axes of rotation $D_g$ and $D_u$ (i.e., the two axes of rotation $D_g$ and $D_u$ are offset by a defined value), it is ensured in particular that from a certain angle of rotation, the turnover weight 130 is reliably pressed against the surface stop 124 (in the case of large amplitude) and against the surface stop 121 (in the case of small amplitude) of the exciter weight 120. By this means a distinct tipping over and an associated change of amplitude is ensured even if the turnover weight 130 should recoil after impact. The defined spacing of the two axes of rotation $D_g$ and $D_u$ is determined as the inward-pointing distance on the angle bisector of the turning angle, as is explained in detail herein below in connection with FIG. 4.

In order to ensure that from a certain angle of rotation, the turnover weight 130 is reliably pressed with the stop surface 134 against the surface stop 124 of the exciter weight 120, its axis of rotation $D_u$ is consequently offset on the line of the neutral position (angle bisector of the turning angle) by a defined value as is explained hereinafter in connection with FIG. 4.

The center of mass m of the turnover weight 130 moves on an orbit K about the turning point or about the axis of rotation $D_u$. The tipping of the turnover weight 130 takes place between O and T. The turning angle is for example about 180°. The angle bisector of the turning angle shown by the dashed line is given by N. The axis of rotation $D_u$ on the angle bisector N is offset inwards (with respect to the turning angle, i.e., to the left in the diagram) with respect to the axis of rotation $D_g$ by the value e. The value of e can be determined using the formulae given hereinafter depending on the individual case. The calculations are based on the assumption that two significant forces and resulting moments $M_{rest}$ and $M_{fric}$ act on the turnover weight 130 or its mass m. As soon as the restoring moment $M_{rest}$ is greater than the friction moment $M_{fric}$, the turnover weight 130 goes unstoppably onto its respective stop.

Figure 4:
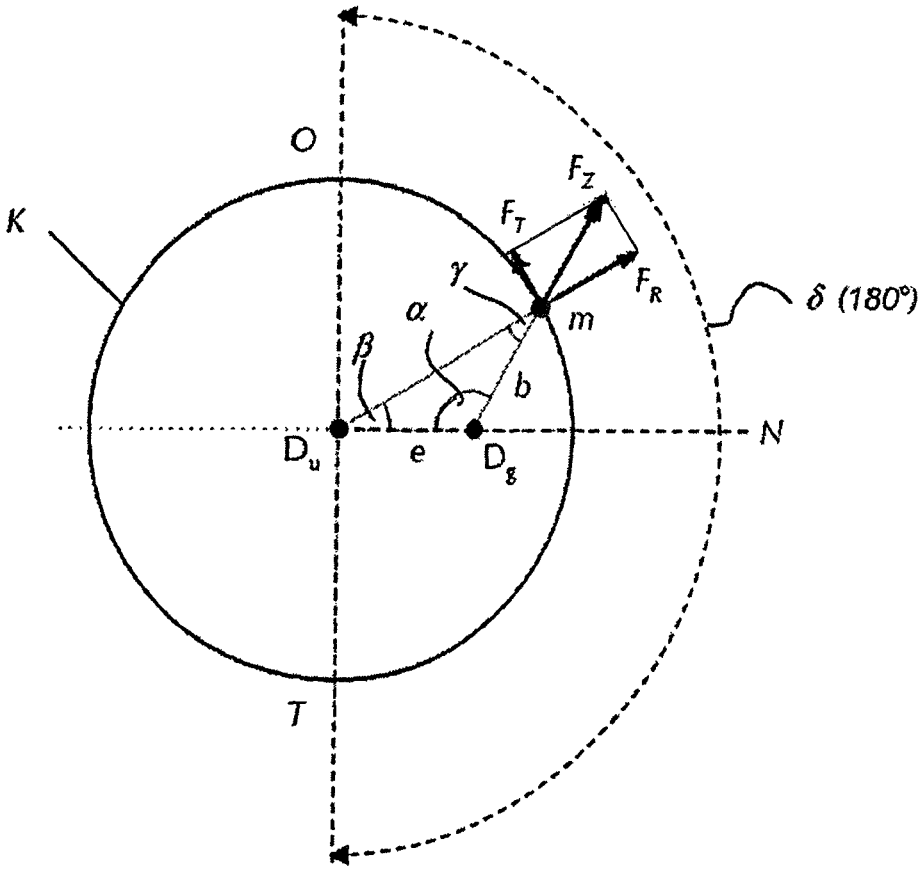
FIG. 4 shows a schematic view to determine the distance of the axes of rotation.

The value e can be determined by the formulae given hereinafter:

$$M_{fric} = M_{rest} \tag{1}$$

$$F_R \cdot \mu \cdot r_{hub} = Fr \cdot ru \tag{2}$$

$$\cos\gamma \cdot F_z \cdot \mu \cdot r_{hub} = \sin\gamma \cdot F_z \cdot ru \tag{3}$$

$$\frac{\sin\gamma}{\cos\gamma} = \tan\gamma = \frac{\mu \cdot r_{hub}}{ru} \tag{4}$$

$$\gamma = \arctan\left(\frac{\mu \cdot r_{hub}}{ru}\right) \tag{5}$$

$$\alpha = 180° - ((\beta - \varepsilon) + \gamma) \tag{6}$$

$$\beta = 0.5 \cdot \delta \tag{7}$$

$$\varepsilon = \frac{\sin\gamma}{\sin\alpha} \cdot ru \tag{8}$$

where:

e (eccentric) distance $M_{fric}$ Friction moment $M_{rest}$ Restoring moment $F_R$ Force (according to FIG. 4)

$F_T$ Force (according to FIG. 4)

$F_Z$ Force (according to FIG. 4)

μ Friction value at the pivot point of the turnover weight (e.g., 0.5)

$r_U$ Centroidal distance (radius) of the mass m to the pivot point $D_u$ $r_{hub}$ Radius of the exciter shaft about which the turnover weight turns α Angle according to FIG. 4

β Angle according to FIG. 4

γ Angle according to FIG. 4

δ Turning angle

ϵ Safety distance to allow for the recoil angle (e.g., 8°)

Figure 5A:
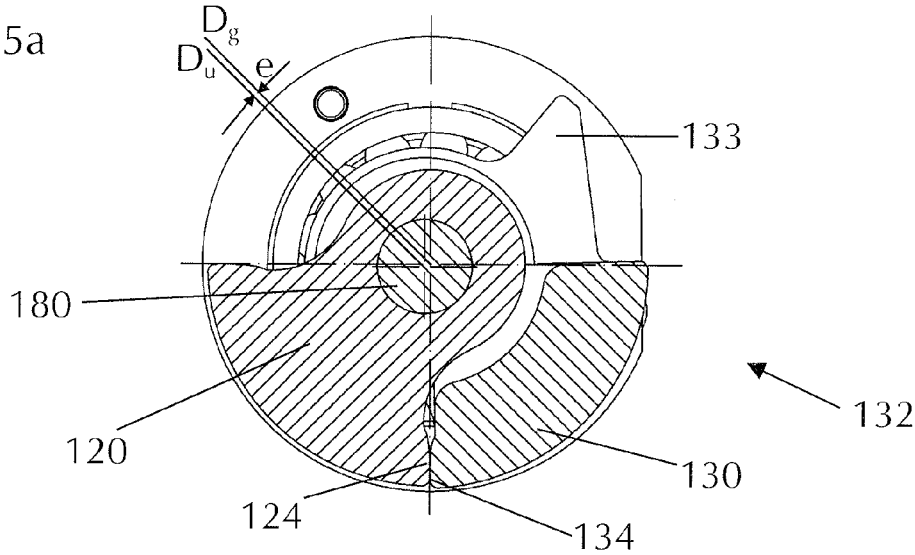
FIGS. 5*a-c* show sectional views along the lines A-A, B-B and C-C from FIG. 1.
Figure 5B:
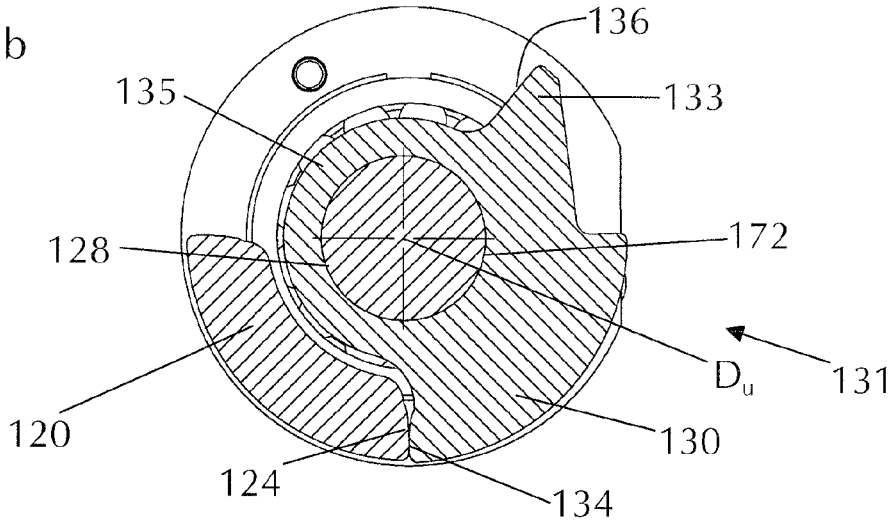
Figure 5C:
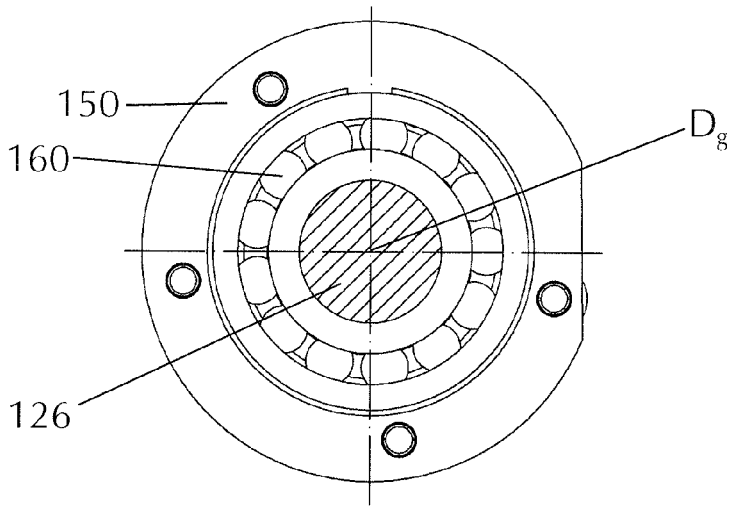

FIGS. 5*a* to 5*c* show different sectional views of the vibration exciter 100. The section along the line A-A is taken through the rear bearing 132 and perpendicular to the axes of rotation $D_g$ and $D_u$ so that the axes of rotation $D_g$ and $D_u$ are merely visible as points. The eccentric distance e between the axes of rotation $D_g$ and $D_u$ is clearly visible. The section along the line B-B is taken through the front bearing 131 and perpendicular to the axes of rotation $D_g$ and $D_u$. The view shown in FIG. 5*b* therefore corresponds to the perspective sectional view shown in FIG. 2. Finally, FIG. 5*c* shows a sectional view along the line C-C where the plane of intersection also runs perpendicular to the axes of rotation $D_g$ and $D_u$ and when viewed in the axial direction, i.e., in the direction of the axes of rotation $D_g$ and $D_u$, is located directly between the one axial end of the turnover weight 130 and the roller bearing 160. The drive pin 126 of the exciter shaft 110 or the exciter weight 120 received by the roller bearing 160 is rotatingly driven by the drive unit, i.e., the motor 140 (not visible here), where the direction of rotation of the motor 140 and therefore of the exciter shaft 110 is crucial for the height of the imbalance produced.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of Applicants' invention.

What is claimed is:

1. A vibration exciter for a ground compactor, comprising:

an exciter shaft rotatable about an axis of rotation ($D_g$) and having at least one exciter weight disposed thereon, and at least one turnover weight having a mass body and being disposed so as to be rotatable about an axis of rotation ($D_u$) relative to the exciter shaft, wherein the axis of rotation ($D_g$) of the exciter shaft and the axis of rotation ($D_u$) of the at least one turnover weight are laterally offset with respect to one another by an offset, and further wherein the offset is accomplished in a plane perpendicular to the axis of rotation ($D_g$) of the exciter shaft and the axis of rotation ($D_u$) of the at least one turnover weight relative to a line of neutral position in a direction pointing away from the side of the mass body on the turnover weight.

2. The vibration exciter according to claim 1, wherein the axes of rotation ($D_g$; $D_u$) of the exciter shaft and the at least one turnover weight lie parallel to one another.

3. The vibration exciter according to claim 1, wherein the axis of rotation ($D_u$) of the at least one turnover weight is offset with respect to the axis of rotation ($D_g$) of the exciter shaft by a defined value (e), wherein the value (e) is measured as an inward-pointing distance on an angle bisector of a turning angle.

4. The vibration exciter according to claim 3, wherein the distance (e) lies in a range of 1 mm to 15 mm.

5. The vibration exciter according to claim 1, wherein the exciter weight is formed in one piece with the exciter shaft.

6. The vibration exciter according to claim 1, wherein the at least one turnover weight is mounted at least at one axial end via a bearing journal on the exciter weight.

7. The vibration exciter according to claim 1, wherein the at least one turnover weight is mounted at least at one axial end via a bearing ring directly on the exciter weight.

8. The vibration exciter according to claim 7, wherein the bearing ring of the turnover weight is disposed in the axial direction of the axis of rotation ($D_g$) of the exciter shaft directly between a drive-side bearing and a stop on the exciter weight.

9. The vibration exciter according to claim 1, wherein a turning angle for the turnover weight lies in the range of 120° to 200°.

10. A soil compactor comprising at least one vibration exciter according to claim 1.

11. The vibration exciter according to claim 4, wherein the distance (e) lies in a range of 1.5 mm to 10 mm.

12. The vibration exciter according to claim 9, wherein the turning angle for the turnover weight lies at about 130°.

* * * * *